United States Patent [19]

Doneaux

[11] 4,193,588

[45] Mar. 18, 1980

[54] NIPPLE AND COLLAR RETAINER

[76] Inventor: Robert G. Doneaux, 1137 E. Orange, Tempe, Ariz. 85281

[21] Appl. No.: 794,824

[22] Filed: May 9, 1977

[51] Int. Cl.[2] ..... B25B 11/00

[52] U.S. Cl. ..... 269/47; 269/287; 269/321 W

[58] Field of Search ..... 211/41, 13; 206/557, 206/562, 563, 565; 269/287, 321 W, 47; 113/116 A; 29/6.1

[56] References Cited

U.S. PATENT DOCUMENTS

| | | | |
|---|---|---|---|
| 2,018,085 | 10/1935 | Otte | 113/116 A |
| 2,472,028 | 5/1949 | Son | 206/565 |
| 3,258,127 | 6/1966 | Cushing | 211/41 |

*Primary Examiner*—Robert C. Watson

*Attorney, Agent, or Firm*—Cahill, Sutton & Thomas

[57] ABSTRACT

A planar retaining member supports baby bottle nipples and nipple attaching collars during washing of the nipples and collars in an automatic dishwasher. The member includes apertures for penetrable retention of the nipples and flexible arms for extending through and loosely releasably engaging the collars.

5 Claims, 3 Drawing Figures

NIPPLE AND COLLAR RETAINER

The present invention is related to washing racks for baby bottle nipples and nipple attaching collars and, more particularly, to apparatus for supporting baby bottle nipples and collars in automatic dishwashers.

Most babies receive a substantial if not all of their liquid food intake from baby bottles. This food is generally very rich and is highly susceptible to development of injurious and infectious cultures of bacteria. Consequently, washing and sterilization of the baby bottle components should be thorough and complete.

Automatic dishwashers are very thorough in removing particles of food and they operate at water temperatures higher than possible for hand washing. Accordingly, they are very attractive for washing and even sterilizing the components of baby bottles.

The effectiveness of an automatic dishwasher is, to a large extent, predicated upon the manner in which the items to be washed are loaded within the dishwasher. For this reason, all automatic dishwashers have racks especially constructed to support dishes, cups, glasses, silverware, etc. in a particular manner at a particular location. The bottle of a baby bottle is effectively washable within an automatic dishwasher if it is placed at the portion of the rack normally reserved for glasses. But, the nipple for a baby bottle and the collar for securing the nipple to the baby bottle are not effectively supportable upon any portion of the rack. They are generally either dumped into a bin for the silverware or otherwise simply laid upon a supporting mesh of the rack. Consequently, the washing effectiveness of the automatic dishwasher is open to question and hygenic cleaning of the nipples and the collars is primarily a matter of happenstance.

It is therefore a primary object of the present invention to provide a retaining member for effecting the washing of baby bottle nipples and collars within an automatic dishwasher.

Yet another object of the present invention is to provide a retaining member for positioning and subjecting baby bottle nipples and collars to the washing and rinsing cycles of an automatic dishwasher.

Still another object of the present invention is to provide a retaining member for independently supporting each of a plurality of baby bottle nipples and collars.

A further object of the present invention is to provide a thin planar retaining member for supporting baby bottle nipples and collars.

A yet further object of the present invention is to provide an easily storable retaining member for baby bottle nipples and collars.

A still further object of the present invention is to provide a planar retaining member having flexible elements for releasably and independently securing baby bottle nipples and collars.

A still further object of the present invention is to prevent baby bottle nipples and collars washed in automatic dishwashers from being propelled by the force of the water onto the heating coils at the bottom of the automatic dishwasher.

These and other objects of the present invention will become apparent to those skilled in the art as the description thereof proceeds.

The present invention may be described with greater specificity and clarity with reference to the following drawings, in which.

A popular one of the several commercially available baby bottles includes a bottle portion, a nipple seated at the mouth of the bottle and a collar for retaining the nipple in place as well as insuring a seal intermediate the bottle mouth and the nipple. Generally, there is little problem in adequately cleaning the bottles in an automatic dishwasher if the bottles are placed at the locations specifically designed for glasses. However, the nipples and collars are not readily mountable upon the racks of the automatic dishwasher and consequently are often simply placed within a basket intended to receive silverware or other implements. Since these baskets are not designed to effect complete washing of items of the configuration of nipples annd collars, adequate washing is often a matter of happenstance. Without adequate washing of all elements of the baby bottle, the spread of disease and infection to an infant is greatly increased. In the absence of a means for securely retaining baby bottle nipples and collars, they may be propelled by the force of water onto the heating coils at the bottom of an automatic dishwasher and cause damage to the dishwasher.

Figure 1:
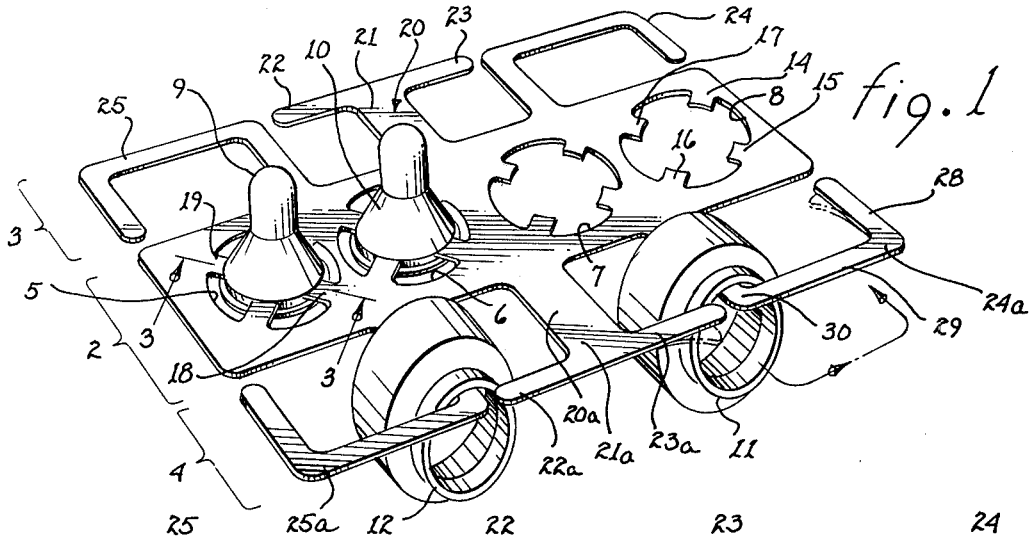
FIG. 1 is a perspective view of a retaining member for supporting baby bottle nipples and collars.
Figure 2:
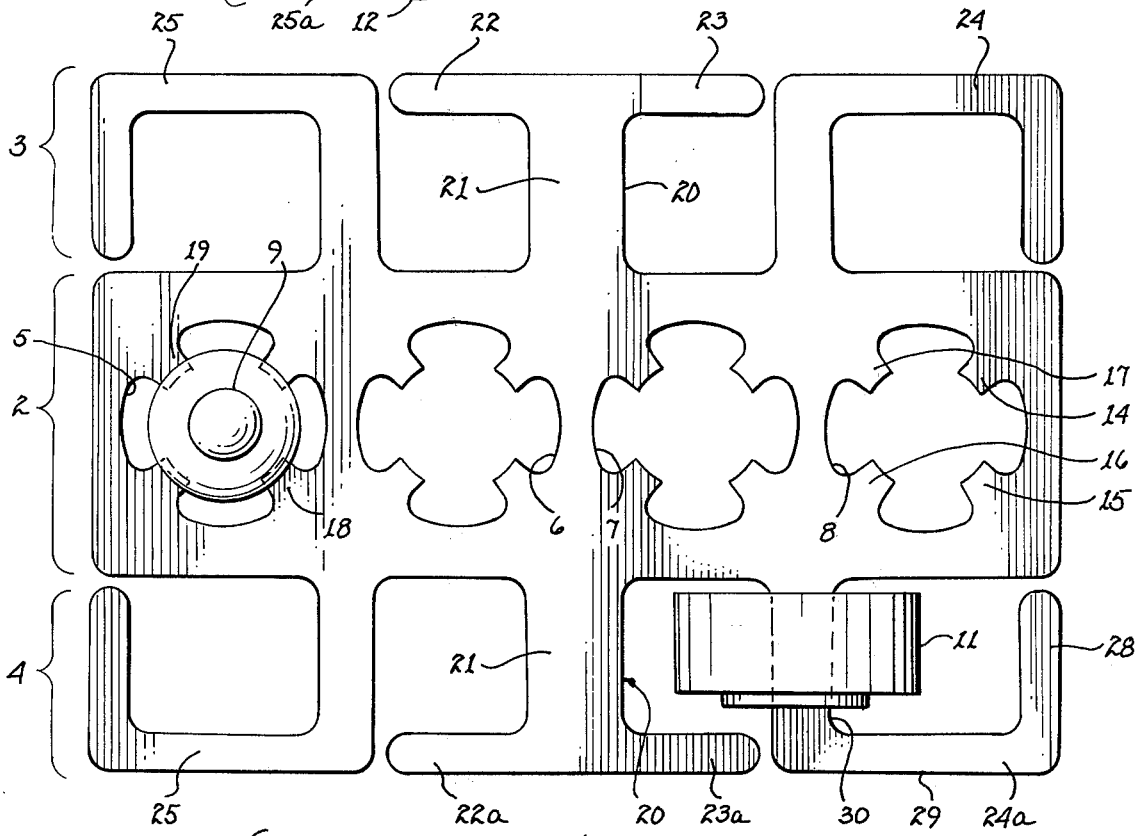
FIG. 2 is a plan view of the baby bottle nipple and collar retaining member.
Figure 3:
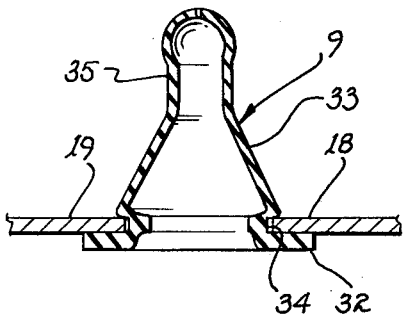
FIG. 3 is a cross-sectional view taken along lines 3—3, as shown in FIG. 1.

Referring to FIGS. 1 and 2, there is shown a retaining member 1 having a central longitudinally extending section 2 and a pair of longitudinally extending lateral sections 3 and 4. The central section includes a plurality of apertures 5, 6, 7 and 8, each of which is configured to penetrably receive and removably retain a baby bottle nipple. For purposes of illustration, nipples 9 and 10 are illustrated in FIG. 1 as lodged within apertures 5 and 6. Each of the apertures, such as aperture 8, includes inwardly extending tabs 14, 15, 16 and 17. The inner edges of these tabs represent points upon a circle, which circle is commensurate with the diameter of the annular groove located at the base of each nipple, as illustrated in FIG. 3. Thereby, these tabs retain the nipple in place and yet, because of the flexibility of the materials from which the nipples are constructed, allow for easy insertion and removal of the nipples. Each of the remaining apertures, apertures 5, 6 and 7, are similarly constructed.

Lateral section 3, which is a mirror image of lateral section 4, includes a central T-shaped element 20 having a laterally extending base 21 and longitudinally extending arms 22 and 23. A hook-shaped arm 24 extends laterally from central section 2 proximate the extremity of arm 23 but slightly displaced therefrom. The extremity of arm 24 is turned back toward central section 2 but terminates short of contact therewith. An identical but reversely oriented hook-shaped arm 25 extends laterally from central section 2 in proximity to the extremity of arm 22. The extremity of arm 25 is also turned back toward central section 2 but is not in contact therewith. Lateral section 4 is developed as an identical but a mirror image of lateral section 3; for purposes of clarity and brevity, the elements of lateral section 4 are identified with the same numerals plus the addition of subscript "a" as the corresponding elements of lateral section 3.

Collars, such as collars 11 and 12, are supportingly mounted upon arms **24*a* and 25*a*, respectively, as illustrated in FIG. 1. The mounting of a collar is performed as follows. One side of a collar, such as collar 11, is slid intermediate the extremity of arm 24***a* and central section 2 until segment 28 penetrates through the collar. Some bending of segment 28*a* (as illustrated in dashed lines) may be necessary, depending upon the extent of the spacing intermediate the extremity of the arm and the central section. Thence, the collar is slid along segment 29 onto segment 30. In transitioning to segment 30, the side of the collar is slid intermediate the extremity of arm 23*a* at the junction of segments 29 and 30. Some bending of arm 23*a* (as illustrated in dashed lines) may be necessary. Once in position, collar 11 is loosely supported to move in all axes with a limited degree of freedom. Such movement aids in the washing and rinsing operations; however, because arm 23*a* serves a locking function, the collar cannot, except by the application of an external force, become dislodged from about segment 30.

Referring now to FIG. 3, there is shown a cross-sectional view of nipple 9 mounted within aperture 5. Nipple 9, of the type for which apertures 5, 6, 7 and 8 were specifically intended, has a base developed from an annular flange 32 supporting a hollow truncated cone 33 terminated by nipple portion 35. A depression or groove 34 is disposed intermediate the flange and the collar for engaging the inwardly extending annular flange of the collar to effect a seal therebetween on attachment of the nipple to a baby bottle. By adapting the tabs extending inwardly within aperture 5 to terminate at points defining a circle having a diameter equivalent to the diameter described by the base of groove 34, the tabs engage the groove on penetrable insertion of nipple 9 into the aperture. Because of the side walls of groove 34, both the upper and lower surfaces of the tabs are engaged (note tabs 18 and 19 in FIG. 3) and the nipple is locked in place within aperture 5.

After retaining member 1 has been loaded with one or more sets of nipples and collars, the retaining member is placed upon one of the racks within an automatic dishwasher. Because of the overall mass of a loaded retaining member, the nipples and collars with not bounce around inside the dishwasher in response to high pressure water sprays; instead, it will be subjected to the cleaning action of the water and the detergent used. Additionally, since no special modifications have to be made to any existing dishwasher rack, the dishwasher can be continued to be operated in the normal manner without rearrangement to accommodate the washing of the nipples and collars. It has even been found that if the retaining member is placed upon an already loaded rack of an automatic dishwasher, complete and proper washing of the nipples and collars is still achieved. Since the retaining member is planar and of relatively small size, it is easily stored in a drawer, upon a shelf or even within the dishwasher without impeding the utility of the dishwasher during its normal washing operations.

Preferably, the retaining member is manufactured from one of the well known man-made plastics which renders it inexpensive to manufacture while providing a certain degree of flexibility and resiliency to permit ready mounting and dismounting of the nipples and collars.

While the principles of the invention have now been made clear in an illustrative embodiment, there will be immediately obvious to those skilled in the art many modifications of structure, arrangement, proportions, elements, materials, and components used in the practice of the invention which are particularly adapted for specific environments and operating requirements without departing from those principles.

I claim:

1. A retaining member for supporting baby bottle nipples and collars in automatic dishwashers, said member comprising in combination:

a. a planar member;

b. a first section developed as part of said planar member for detachably supporting the nipples, said first section including at least one aperture for receiving an individual one of the nipples, each said aperture including an inwardly extending tab for bearing against the surface of and supporting an aperture inserted one of the nipples; and c. a second section developed as part of said planar member for detachably supporting the collars, said second section including at least one arm means for penetrably supporting an individual one of the collars.

2. The member as set forth in claim 1 wherein each said arm means comprises a first arm for penetrably supporting one of the collars and a second arm for restraining disengagement of the supported collar from said first arm.

3. A retaining member for supporting baby bottle nipples and collars in automatic dishwashers, said member comprising in combination:

a. a planar member;

b. a first section developed as part of said planar member for detachably supporting the nipples, said first section including an aperture for receiving one of the nipples, each said aperture including inwardly extending tabs for bearing against the surface of and supporting an aperture inserted one of the nipples;

c. a second section developed as part of said planar member for detachably supporting the collars, said second section including arm means for penetrably supporting one of the collars, each said arm means including a first arm for penetrably supporting one of the collars and a second arm for restraining disengagement of the supported collar from said first arm; and d. a third section developed as part of said planar member for detachably supporting additional collars, said third section including means for engaging individual ones of the additional collars, second and third sections being disposed at opposed sides of said first section.

4. The member as set forth in claim 3 wherein said first section includes four of said apertures, said second section includes a pair of said arm means and said third section includes a pair of said arm means.

5. The member as set forth in claim 4 wherein said first arms of said pair of arm means in said second and third sections comprises a T-section and each said second arm of said pair of arm means in said second and third sections comprises a hook-shaped arm.

* * * * *